US009482999B2

(12) United States Patent
Koyanagi et al.

(10) Patent No.: US 9,482,999 B2
(45) Date of Patent: Nov. 1, 2016

(54) HEATING DEVICE, FIXING DEVICE, AND IMAGE FORMING APPARATUS

(71) Applicant: FUJI XEROX CO., LTD., Tokyo (JP)

(72) Inventors: Kiyoshi Koyanagi, Kanagawa (JP); Toru Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/803,206

(22) Filed: Jul. 20, 2015

(65) Prior Publication Data

US 2016/0246226 A1 Aug. 25, 2016

(30) Foreign Application Priority Data

Feb. 20, 2015 (JP) ..... 2015-032241

(51) Int. Cl.
*G03G 15/20* (2006.01)
*H05B 3/00* (2006.01)
*H05B 3/06* (2006.01)

(52) U.S. Cl.
CPC ..... *G03G 15/2053* (2013.01); *H05B 3/0014* (2013.01); *H05B 3/06* (2013.01)

(58) Field of Classification Search
None
See application file for complete search history.

(56) References Cited

U.S. PATENT DOCUMENTS 3,886,401 A * 5/1975 Berg ..... H04N 5/63 315/100
2009/0245900 A1* 10/2009 Kagawa ..... G03G 15/2042 399/329

FOREIGN PATENT DOCUMENTS

JP 2013-011649 A 1/2013

* cited by examiner

*Primary Examiner* — Minh Phan
*Assistant Examiner* — Victor Verbitsky
(74) *Attorney, Agent, or Firm* — Sughrue Mion, PLLC

(57) ABSTRACT

A heating device includes a rotating member that rotates, and plural unit circuits that are aligned in a width direction of the rotating member. The plural unit circuits each includes a heating body that heats the rotating member, a resistive element that is connected in series to the heating body and has a positive temperature coefficient, and a parallel circuit that is connected in parallel to the resistive element. The unit circuits are each configured such that, if a resistance value of the resistive element is increased with a rise of temperature of the resistive element, a current flows through the parallel circuit.

5 Claims, 11 Drawing Sheets

HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-032241 filed Feb. 20, 2015.

BACKGROUND

Technical Field

The present invention relates to a heating device, a fixing device, and an image forming apparatus.

SUMMARY

According to an aspect of the invention, there is provided a heating device including a rotating member that rotates, and plural unit circuits that are aligned in a width direction of the rotating member. The plural unit circuits each includes a heating body that heats the rotating member, a resistive element that is connected in series to the heating body and has a positive temperature coefficient, and a parallel circuit that is connected in parallel to the resistive element. The unit circuits are each configured such that, if a resistance value of the resistive element is increased with a rise of temperature of the resistive element, a current flows through the parallel circuit.

BRIEF DESCRIPTION OF THE DRAWINGS

Exemplary embodiments of the present invention will be described in detail based on the following figures, wherein.

DETAILED DESCRIPTION

First Exemplary Embodiment

Image Forming Apparatus 1

Figure 1:
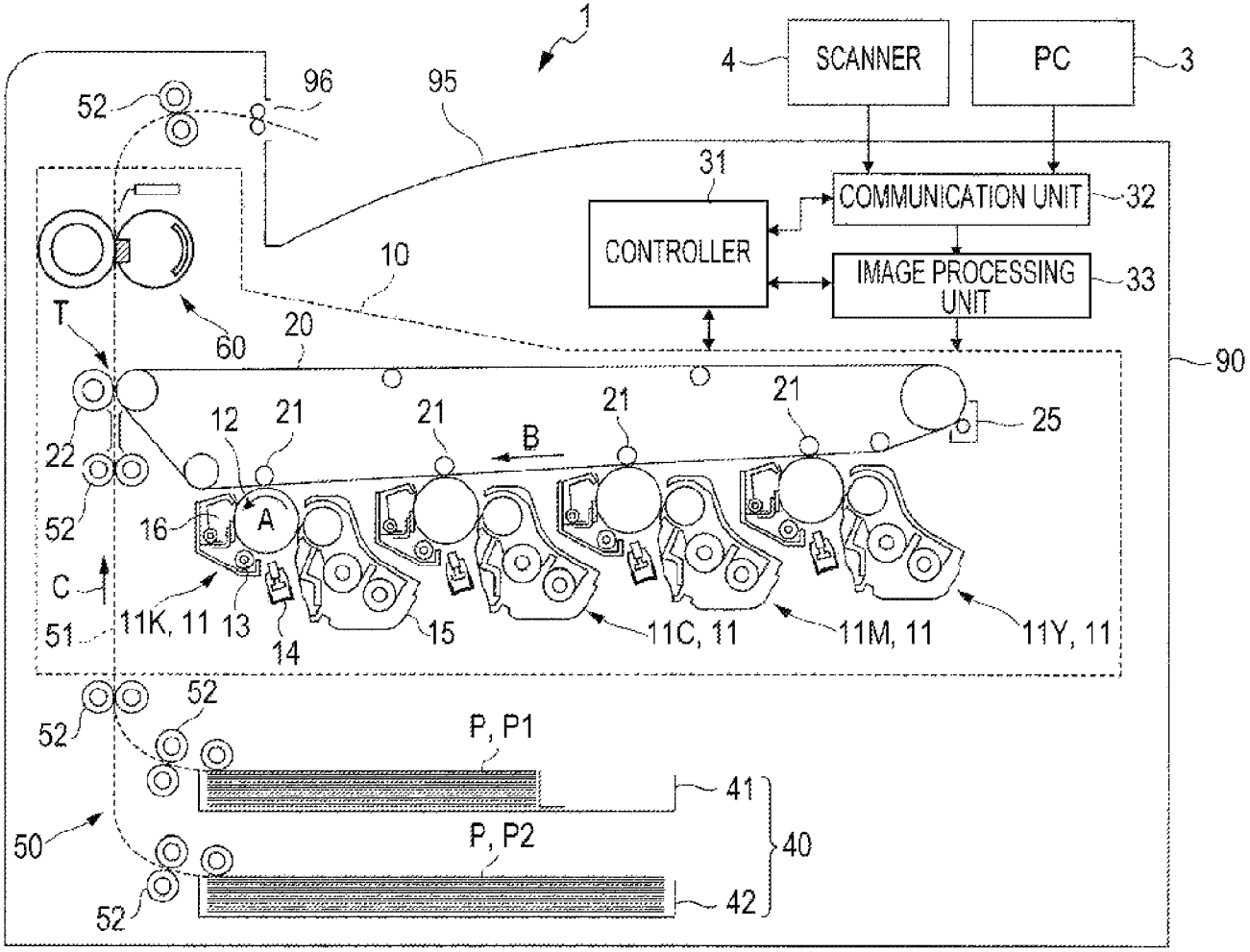
FIG. 1 is a schematic sectional view of an image forming apparatus according to a first exemplary embodiment of the present invention.

FIG. 1 is a schematic sectional view of an image forming apparatus 1 according to a first exemplary embodiment of the present invention. The image forming apparatus 1 is an electrophotographic color printer that prints images on the basis of image data.

The image forming apparatus 1 includes a body case 90, in which a sheet container unit 40 that contain sheets P (exemplary recording media), an image forming section 10 that forms an image on each of the sheets P, and a transporting portion 50 that transports the sheet P from the sheet container unit 40 through the image forming section 10 up to a sheet output port 96 provided in the body case 90. The image forming apparatus 1 further includes a controller 31 that controls the entire operation of the image forming apparatus 1, a communication unit 32 that communicates with, for example, a personal computer (PC) 3 or an image reading apparatus (scanner) 4 and receives image data therefrom, and an image processing unit 33 that processes the image data received by the communication unit 32.

The sheet container unit 40 includes a first sheet container 41 and a second sheet container 42 that contain sheets P of two different sizes, respectively. The first sheet container 41 contains sheets P1 of, for example, size A4. The second sheet container 42 contains sheets P2 of, for example, size B4. Hereinafter, the sheets P1 are also referred to as small-size sheets P1, and the sheets P2 are also referred to as large-size sheets P2. The two kinds of sheets P1 and P2 are collectively referred to as "sheets P" if there is no need to distinguish the sheets P1 and P2 from each other.

The transporting portion 50 includes a transport path 51 extending from each of the first sheet container 41 and the second sheet container 42, passing through the image forming section 10, and reaching the sheet output port 96, and pairs of transport rollers 52 that transport the sheet P along the transport path 51. The sheet P1 or P2 is transported by the transporting portion 50 such that the long sides thereof extend in the direction of transport represented by arrow C.

The image forming section 10 includes four image forming units 11Y, 11M, 11C, and 11K that are arranged at a predetermined interval. The image forming units 11Y, 11M, 11C, and 11K are hereinafter collectively referred to as "image forming units 11." The image forming unit 11 each include a photoconductor drum 12 on which an electrostatic latent image to be developed into a toner image is to be formed, a charging device 13 that charges the surface of the photoconductor drum 12 with a predetermined potential, a light-emitting-diode (LED) printhead 14 that exposes the photoconductor drum 12 charged by the charging device 13 to light emitted therefrom on the basis of a corresponding one of pieces of image data for different colors, a developing device 15 that develops the electrostatic latent image on the photoconductor drum 12 into a toner image, and a drum cleaner 16 that cleans the surface of the photoconductor drum 12 after the transfer.

The four image forming units 11Y, 11M, 11C, and 11K all have the same configuration, except toners contained in the respective developing devices 15. The image forming unit 11Y including the developing device 15 that contains a yellow (Y) toner forms a yellow toner image. Likewise, the image forming unit 11M including the developing device 15 that contains a magenta (M) toner forms a magenta toner image, the image forming unit 11C including the developing device 15 that contains a cyan (C) toner forms a cyan toner image, and the image forming unit 11K including the developing device 15 that contains a black (K) toner forms a black toner image.

The image forming section 10 further includes an intermediate transfer belt 20 to which the toner images in the respective colors on the respective photoconductor drums 12 of the respective image forming units 11 are transferred in such a manner as to be superposed one on top of another, and first transfer rollers 21 that sequentially electrostatically transfer the toner images in the respective colors formed by the respective image forming units 11 to the intermediate transfer belt 20 (a first transfer). The image forming section 10 further includes a second transfer roller 22 provided in a second transfer part T and that electrostatically transfers the toner images in the respective colors superposed on the intermediate transfer belt 20 to a sheet P collectively (a second transfer), and a fixing unit 60 (an exemplary fixing device) that fixes the superposed toner images transferred to the sheet P to the sheet P.

The image forming apparatus 1 performs the following image forming process under the control of the controller 31. Specifically, image data transmitted from the PC 3 or the scanner 4 is received by the communication unit 32 and is processed in a predetermined manner by the image processing unit 33, whereby pieces of image data for the respective colors are generated. The pieces of image data for the respective colors are transmitted to the respective image forming units 11 provided for the respective colors. Subsequently, in the image forming unit 11K that forms a black toner image, for example, the photoconductor drum 12 rotating in a direction of arrow A is charged with a predetermined potential by the charging device 13.

Subsequently, the LED printhead 14 performs scan exposure on the photoconductor drum 12 on the basis of black image data transmitted from the image processing unit 33, whereby an electrostatic latent image corresponding to the black image data is formed on the photoconductor drum 12. The electrostatic latent image for black on the photoconductor drum 12 is then developed into a black toner image by the developing device 15. Likewise, the image forming units 11Y, 11M, and 11C form yellow, magenta, and cyan toner images, respectively.

The toner images in the respective colors thus formed on the photoconductor drums 12 of the image forming units 11 are sequentially electrostatically transferred to the intermediate transfer belt 20 by the respective first transfer rollers 21 in such a manner as to be superposed one on top of another while the intermediate transfer belt 20 is rotating in a direction of arrow B, whereby a set of superposed toner images in the respective colors is formed on the intermediate transfer belt 20.

With the rotation of the intermediate transfer belt 20 in the direction of arrow B, the set of superposed toner images on the intermediate transfer belt 20 is transported to the second transfer part T. Synchronously with the transport of the set of superposed toner images to the second transfer part T, a sheet P is transported from the sheet container unit 40 in the direction of arrow C along the transport path 51 by the pairs of transport rollers 52 of the transporting portion 50. Then, the set of superposed toner images on the intermediate transfer belt 20 is collectively electrostatically transferred, with a transfer electric field produced by the second transfer roller 22 in the second transfer part T, to the sheet P transported along the transport path 51.

Subsequently, the sheet P carrying the set of superposed toner images that has been electrostatically transferred thereto is transported to the fixing unit 60 along the transport path 51. The set of superposed toner images on the sheet P transported to the fixing unit 60 is subjected to heat and pressure applied thereto by the fixing unit 60, whereby the set of superposed toner images is fixed to the sheet P. The sheet P having the fixed set of superposed toner images is transported along the transport path 51 and is discharged from the sheet output port 96 provided in the body case 90 onto a sheet stacking portion 95 that receives the sheet P.

Meanwhile, toners remaining on the photoconductor drums 12 after the first transfer and toners remaining on the intermediate transfer belt 20 after the second transfer are removed by the drum cleaners 16 and a belt cleaner 25, respectively.

The above image forming process performed by the image forming apparatus 1 for printing an image on a sheet P is repeated a number of times corresponding to the number of pages to be printed.

Fixing Unit 60

Figure 2:
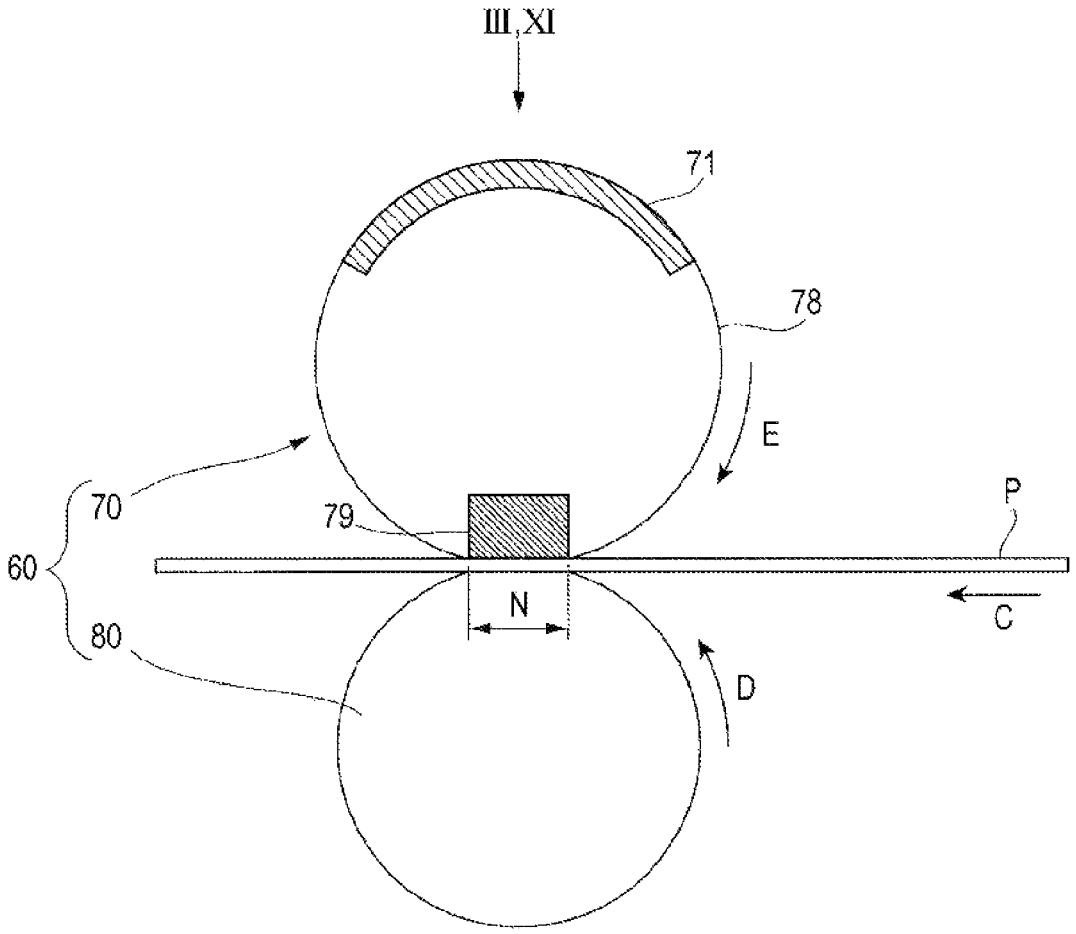
FIG. 2 is a sectional view of a fixing unit included in the image forming apparatus.

FIG. 2 is a sectional view of the fixing unit 60 included in the image forming apparatus 1.

The fixing unit 60 includes a heater unit 70 (an exemplary heating device) and a pressure roller 80 (an exemplary pressing member). The heater unit 70 and the pressure roller 80 each have a round columnar shape whose axis extends in the depth direction in FIG. 2.

The heater unit 70 includes a rotating fixing belt 78 (an exemplary rotating member), a solid heater 71 that has an arc sectional shape and generates heat, and a pressure pad 79 that is pressed by the pressure roller 80 with the fixing belt 78 interposed therebetween.

The fixing belt 78 has an endless cylindrical shape, and the inner circumferential surface thereof is in contact with the outer circumferential surface of the solid heater 71 and the pressure pad 79. The fixing belt 78 is heated by being in contact with the solid heater 71.

The pressure roller 80 is pressed against the outer circumferential surface of the fixing belt 78, whereby a nip part N through which a sheet P carrying an unfixed set of superposed toner images passes is provided between the pressure roller 80 and the fixing belt 78. The pressure roller 80 is rotated in a direction of arrow D by a driving device (not illustrated).

The sheet P transported to the nip part N by the transporting portion 50 (see FIG. 1) is heated by the fixing belt 78 and is pressed between the pressure pad 79 and the pressure roller 80 together with the fixing belt 78 in the nip part N. Thus, the unfixed set of superposed toner images carried by the sheet P is fixed to the sheet P.

In the nip part N, the sheet P that is in contact with the pressure roller 80 is moved in the direction of arrow C with the rotation of the pressure roller 80 in the direction of arrow D. The movement of the sheet P causes the fixing belt 78 that is in contact with the sheet P to rotate in a direction of arrow E (a direction of forward rotation).

Solid Heater 71

Figure 3:
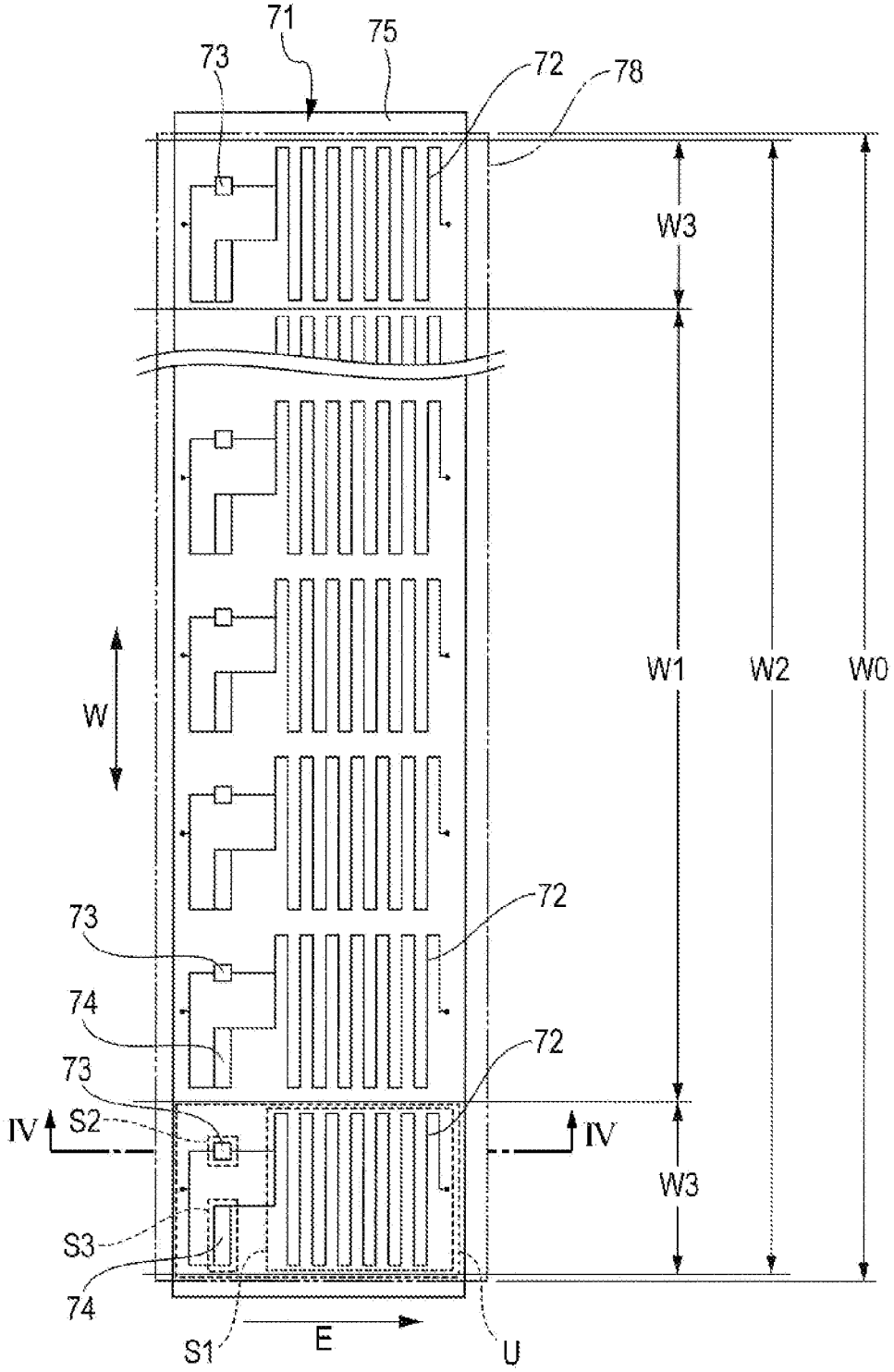
FIG. 3 illustrates a solid heater according to the first exemplary embodiment that is seen in a direction of arrow III illustrated in FIG. 2.

FIG. 3 illustrates the solid heater 71 according to the first exemplary embodiment that is seen in a direction of arrow III illustrated in FIG. 2.

The solid heater 71 includes plural unit circuits U and a supporting member 75 that supports the plural unit circuits U. The unit circuits U each include a resistance heating body 72 (an exemplary heating body), a positive-temperature-coefficient (PTC) element 73 (an exemplary resistive element having a positive temperature coefficient), and a resistor 74.

The resistance heating body 72 is made of, for example, AgPd.

The PTC element 73 is made of, for example, barium titanate. The PTC element 73 is a small chip of size, for example, 2 mm (length)×2 mm (width)×0.1 mm (thickness).

The resistor 74 is, for example, a metal-glaze resistor.

The supporting member 75 extends in a width direction W of the fixing belt 78 (the direction in which the axis of rotation of the fixing belt 78 extends).

In each of the unit circuits U, the PTC element 73 is connected in series to the resistance heating body 72, and the resistor 74 is connected in parallel to the PTC element 73. That is, the resistor 74 serves as a parallel circuit with respect to the PTC element 73.

The PTC element 73 is provided on the upstream side of the fixing belt 78 in the direction of forward rotation E of the fixing belt 78. The resistance heating body 72 is provided on the downstream side of the fixing belt 78 in the direction of forward rotation E of the fixing belt 78. The resistor 74 is provided on the upstream side of the fixing belt 78 in the direction of forward rotation E of the fixing belt 78 and adjacent to the PTC element 73.

The unit circuits U are aligned in the width direction W of the fixing belt 78 on the supporting member 75 of the solid heater 71.

The size of each resistance heating body 72 in the width direction W is set such that adjacent ones of the resistance heating bodies 72 are positioned close to each other. Thus, the temperature distribution of the fixing belt 78 is made even.

As described above, the PTC element 73 is a small chip.

The resistor 74 is provided adjacent to the PTC element 73 such that the resistor 74 serves as a parallel circuit with respect to the PTC element 73.

Hence, in each of the unit circuits U provided on the supporting member 75, an area S2 occupied by the PTC element 73 and an area S3 occupied by the resistor 74 are each smaller than an area S1 occupied by the resistance heating body 72. Thus, the fixing belt 78 is efficiently heated by the resistance heating bodies 72.

Now, the relationship among a width W0 of the fixing belt 78 and respective widths W1 and W2 of the sheets P1 and P2 each carrying a set of superposed toner images that is to be fixed by the fixing unit 60 will be described.

The width W0 of the fixing belt 78 is slightly smaller than the length of the solid heater 71 in the width direction W of the fixing belt 78. Therefore, the fixing belt 78 is heated over the entirety of the width W0 by the plural resistance heating bodies 72 included in the solid heater 71.

The sheets P that are to be subjected to the fixing process in the nip part N of the fixing unit 60 include two kinds of sheets P1 and P2. The width W2 of the sheet P2 that is the larger one having the size, for example, B4 is only slightly smaller than the width W0 of the fixing belt 78. Therefore, the sheet P2 is expected to cover all of the unit circuits U of the solid heater 71.

On the other hand, the width W1 of the sheet P1 that is the smaller one having the size, for example, A4 is much smaller than the width W0 of the fixing belt 78. Therefore, some of the unit circuits U that are provided at the two ends of the supporting member 75 are not expected to be covered with the sheet P1. In the case illustrated in FIG. 3, two unit circuits U provided at the two respective ends of the supporting member 75 are not expected to be covered with the sheet P1.

Hence, in an area extending in the width direction W and having the width W2 of the large-size sheet P2, portions (each having a width W3) on the outer sides of an area having the width W1 of the small-size sheet P1 are referred to as out-of-path areas that are out of the area over which the small-size sheet P1 passes during the fixing process performed on the small-size sheet P1, whereas a portion having the width W1 of the small-size sheet P1 is referred to as an in-path area over which the sheet P1 passes during the fixing process performed on the small-size sheet P1.

In the first exemplary embodiment, the unit circuits U each including the resistance heating body 72, the PTC element 73, and the resistor 74 are arranged over the entirety of an in-path area for the large-size sheet P2 that has the width W2. Alternatively, only the resistance heating bodies 72 may be provided in the in-path area for the small-size sheet P1 that has the width W1, and the unit circuits U each including the resistance heating body 72, the PTC element 73, and the resistor 74 may be provided only in the out-of-path areas for the small-size sheet P1 that each have the width W3.

Figure 4:
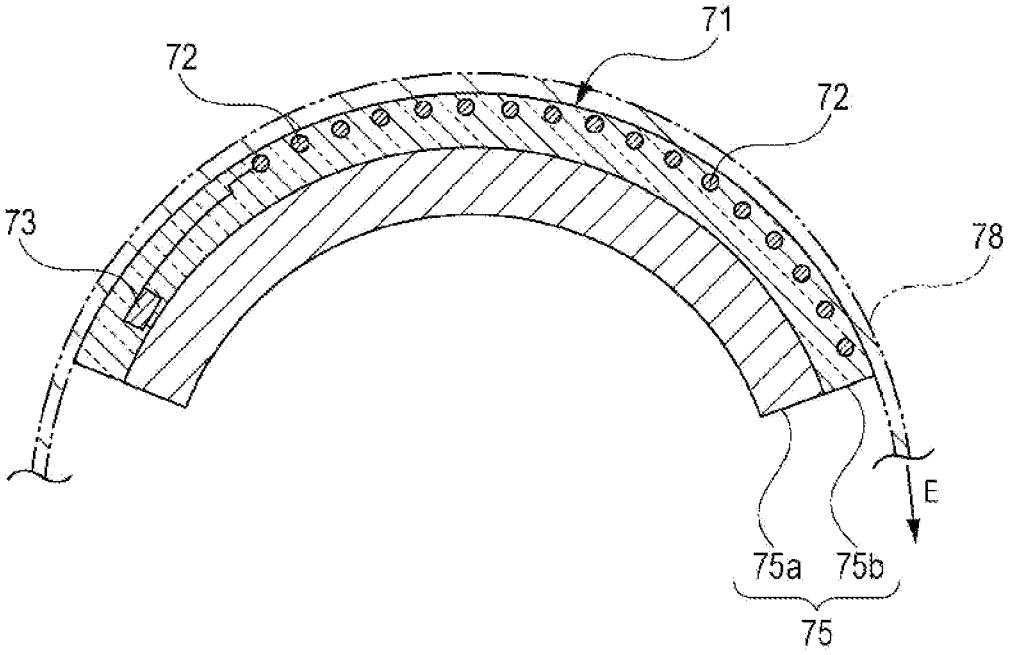
FIG. 4 is a sectional view of the solid heater that is taken along line IV-IV illustrated in FIG. 3.

FIG. 4 is a sectional view of the solid heater 71 that is taken along line IV-IV illustrated in FIG. 3.

The section of the supporting member 75 has an arc shape. The supporting member 75 includes a base member 75*a* provided on the radially inner side thereof, and a glass coat 75*b* stacked on the base member 75*a* on the radially outer side thereof.

The base member 75*a* is made of, for example, stainless steel, or a cladding material in which a stainless-steel plate and a copper plate are joined to each other in the thickness direction thereof.

The resistance heating bodies 72, the PTC elements 73, and the resistors 74 are provided in the glass coat 75*b* stacked on the base member 75*a*. The glass coat 75*b* insulates the resistance heating bodies 72, the PTC elements 73, and the resistors 74 from the fixing belt 78. The glass coat 75*b* may be replaced with a member made of another insulating material such as resin.

The fixing belt 78 is stretched over the outer circumferential surface of the glass coat 75*b* and rotates in the direction of arrow E while being in contact with the glass coat 75*b*.

The solid heater 71 is manufactured as follows, for example.

First, a glass layer that serves as an insulating layer is formed on the base member 75*a* by screen printing and is baked. Subsequently, resistance heating bodies 72 are formed on the glass layer by screen printing. Furthermore, wiring lines for connecting the resistance heating bodies 72 to PTC elements 73 and resistors 74 to be formed thereafter are formed on the glass layer by screen printing. Then, the PTC elements 73 and the resistors 74 are provided at predetermined positions, respectively. Subsequently, a glass layer serving as an insulating layer is formed over the wiring lines, the resistance heating bodies 72, the PTC elements 73, and the resistors 74 and is baked. The baking causes the glass layer to undergo viscous flow, whereby the outer circumferential surface of the glass coat 75*b* is smoothed.

Thus, the glass coat 75*b* in which the wiring lines, the resistance heating bodies 72, the PTC elements 73, and the resistors 74 are provided is obtained.

The solid heater 71 may be manufactured in any other way.

Figure 5:
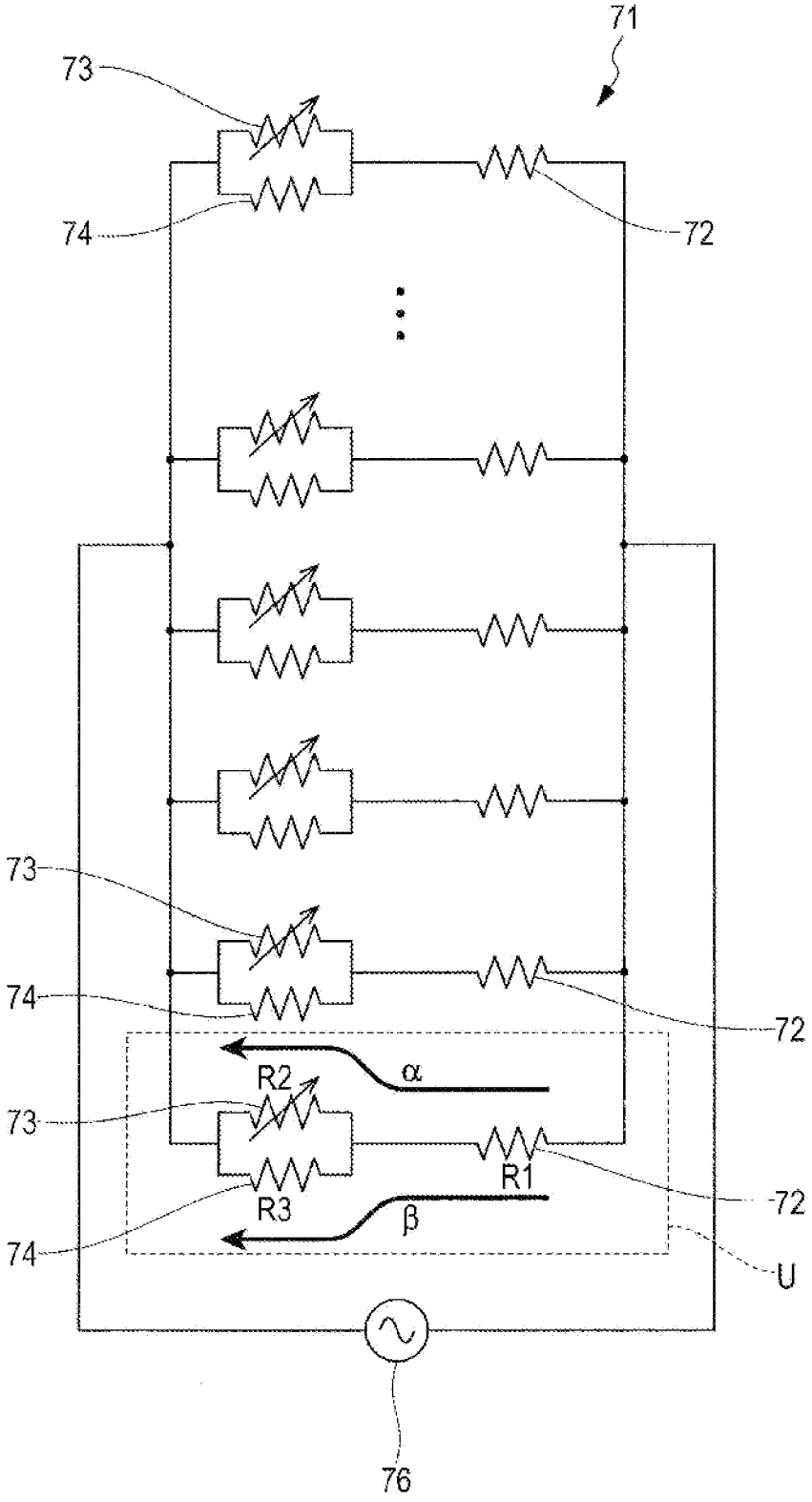
FIG. 5 is an equivalent circuit diagram of the solid heater.

FIG. 5 is an equivalent circuit diagram of the solid heater 71.

In each of the unit circuits U, the PTC element 73 is connected in series to the resistance heating body 72, and the resistor 74 is connected in parallel to the PTC element 73.

The resistance heating body 72 has a resistance value R1. The PTC element 73 has a resistance value R2. The resistor 74 has a resistance value R3.

The plural unit circuits U are connected in parallel to a power source 76.

The power source 76 has, for example, an alternating-current (AC) output of 100 V.

PTC Element 73

Figure 6:
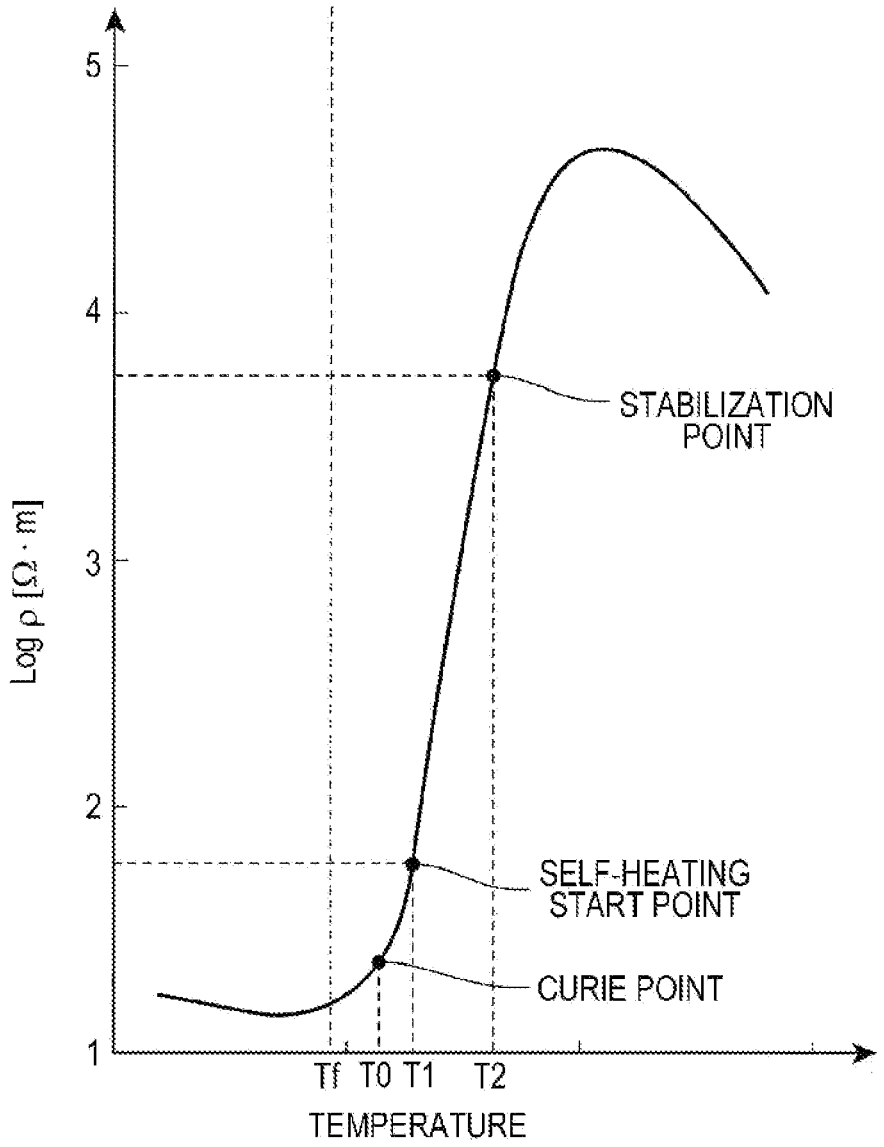
FIG. 6 is a graph illustrating the relationship between the temperature and the resistivity ρ (Ω·cm) of a positive-temperature-coefficient (PTC) element.

FIG. 6 is a graph illustrating the relationship between the temperature and the resistivity ρ (Ω·cm) of the PTC element 73.

When the temperature of the PTC element 73 exceeds a Curie temperature T0 (denoted as Curie point in the graph), the resistivity of the PTC element 73 increases more rapidly than the resistivity of a typical resistor made of metal or the like. That is, the PTC element 73 has a positive temperature coefficient.

When the temperature of the PTC element 73 exceeds a temperature T1, the PTC element 73 starts to generate heat by itself (self-heating) and the temperature of the PTC element 73 rises (this temperature is denoted as self-heating start point in the graph). Accordingly, the resistance value R2 of the PTC element 73 further increases.

The amount of heat generated by the PTC element 73 becomes the same as the amount of heat radiated from the PTC element 73 at a temperature T2, where the temperature and the resistance value of the PTC element 73 are stabilized (this temperature is denoted as stabilization point in the graph).

The Curie temperature T0 of the PTC element 73 is set to a value above a target temperature (a fixing temperature Tf) that needs to be reached for fixing the set of superposed toner images to the sheet P.

As described above, the PTC element 73 has a positive temperature coefficient, and the resistance value R2 thereof changes with the temperature thereof. Hence, in FIG. 5, the PTC element 73 is represented by a symbol of a variable resistor.

The resistance value R2 of the PTC element 73 that is below the Curie temperature T0 is set to about 1/100 of the resistance value R1 of the resistance heating body 72. For example, if the resistance value R1 of the resistance heating body 72 is 100Ω, the resistance value R2 of the PTC element 73 at a normal ambient temperature is 1Ω.

On the other hand, the resistance value R2 of the PTC element 73 that is at the temperature T2 is set to about 100 times the resistance value R1 of the resistance heating body 72. For example, if the resistance value R1 of the resistance heating body 72 is 100Ω, the resistance value R2 of the PTC element 73 at the stabilization point (the temperature T2) is $10^4$Ω.

The resistance value R3 of the resistor 74 is set to several times the resistance value R1 of the resistance heating body 72. For example, if the resistance value R1 of the resistance heating body 72 is 100Ω, the resistance value R3 of the resistor 74 is 600Ω.

That is, the resistance value R3 of the resistor 74 is larger than the resistance value R2 of the PTC element 73 at a temperature below the Curie temperature T0 and is smaller than the resistance value R2 of the PTC element 73 at the temperature T2.

When the PTC element 73 is at a temperature below the Curie temperature T0, the resistance value R2 of the PTC element 73 is smaller than the resistance value R3 of the resistor 74. Hence, in each of the unit circuits U illustrated in FIG. 5, the current takes a route α that passes through the resistance heating body 72 and the PTC element 73.

On the other hand, when the PTC element 73 is at the temperature T2, the resistance value R2 of the PTC element 73 is larger than the resistance value R3 of the resistor 74. Hence, in each of the unit circuits U illustrated in FIG. 5, the current takes a route β that passes through the resistance heating body 72 and the resistor 74.

That is, the route of the current is changed to the route β passing through the resistance heating body 72 and the resistor 74 in accordance with the temperature of the PTC element 73, whereby the amount of current is controlled. In other words, the amount of heat generated by the unit circuit U (the resistance heating body 72 and the PTC element 73 or the resistor 74) is controlled.

Figure 7:
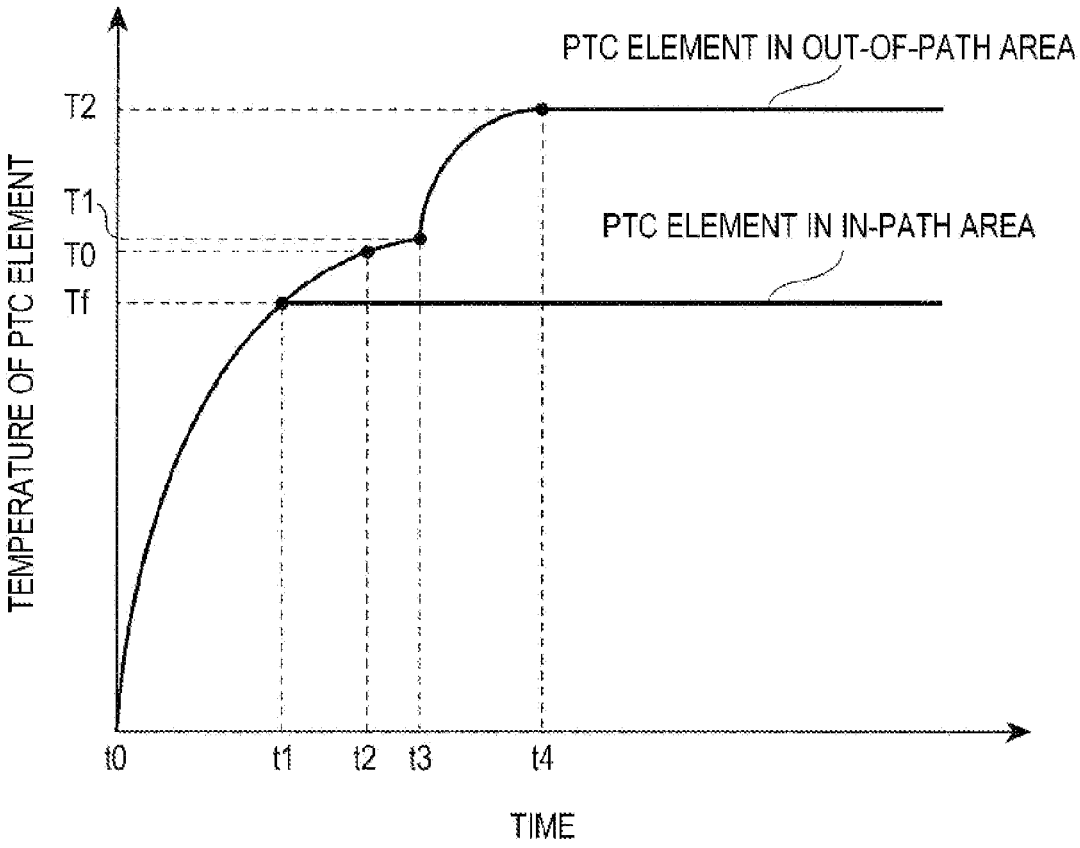
FIG. 7 is a graph illustrating changes in the temperature of the PTC element with respect to time.

FIG. 7 is a graph illustrating changes in the temperature of the PTC element 73 with respect to time. In the graph illustrated in FIG. 7, the vertical axis represents the temperature of the PTC element 73, and the horizontal axis represents time. The time represented by the horizontal axis is only explanatory and may be different from the actual time of temperature change.

Suppose that a small-size sheet P1 is transported through the fixing unit 60. In this case, the temperature of the PTC element 73 is different between that in the in-path area (the area having the width W1 in FIG. 3) over which the small-size sheet P1 passes and that in each of the out-of-path areas (the areas having the width W3 in FIG. 3) that are on the outer sides of the area over which the small-size sheet P1 passes. Such a phenomenon occurs as follows.

When a current is supplied to the solid heater 71 from the power source 76 (see FIG. 5) at time t0, the fixing belt 78 starts to be heated. At time t0, the PTC element 73 is below the Curie temperature T0. Therefore, in each of the unit circuits U, the current takes the route α, illustrated in FIG. 5, passing through the resistance heating body 72 and the PTC element 73.

In this state, the resistance value R1 of the resistance heating body 72 is about 100 times larger than the resistance value R2 of the PTC element 73. Hence, the PTC element 73 consumes substantially no electricity, compared with the resistance heating body 72, and generates substantially no heat. That is, the fixing belt 78 is heated with the heat generated by the resistance heating body 72.

The fixing belt 78 that is rotating in the direction of arrow E illustrated in FIG. 3 is heated over the entirety, in the width direction W, of a portion thereof extending over the solid heater 71 by the resistance heating bodies 72 through the glass coat 75*b* (see FIG. 4).

When the temperature of the fixing belt 78 rises, the temperature of each PTC element 73 also rises. At time t1 when the temperature of the fixing belt 78 (the PTC element 73) has reached the fixing temperature Tf, the small-size sheet P1 starts to be transported through the fixing unit 60.

Here, the PTC elements 73 provided in the in-path area over which the small-size sheet P1 passes will first be described.

When the fixing belt 78 that has been heated as described above rotates and the heated portion thereof has reached the nip part N (see FIG. 2), the heated portion of the fixing belt 78 comes into contact with the sheet P1. In this step, an unfixed set of superposed toner images on the sheet P1 is heated by the fixing belt 78 and is pressed between the pressure pad 79 and the pressure roller 80 in the nip part N. Thus, the unfixed set of superposed toner images on the sheet P1 is fixed to the sheet P1.

Consequently, the temperature of the portion of the fixing belt 78 that has been in contact with the sheet P1 drops. When the fixing belt 78 further rotates in the direction of arrow E and the portion whose temperature has dropped returns to the solid heater 71 illustrated in FIG. 2, the portion is reheated to the fixing temperature Tf by the resistance heating bodies 72 through the glass coat 75*b*.

In this step, the glass coat 75*b* is cooled by exchanging heat with the temperature-dropped portion of the fixing belt 78. Therefore, the temperatures of the PTC elements 73 in the glass coat 75*b* do not exceed the Curie temperature T0 (see FIG. 6).

Thus, the PTC elements 73 provided in the in-path area over which the sheet P1 passes are kept at the fixing temperature Tf.

Now, the PTC elements 73 provided in the out-of-path areas that are on the outer sides of the area over which the small-size sheet P1 passes will be described.

The out-of-path areas of the solid heater 71 do not come into contact with the sheet P1. Therefore, in the out-of-path areas, the fixing belt 78 continues to be heated by the resistance heating bodies 72. Accordingly, the temperature of each of the PTC elements 73 in the out-of-path areas continue to rise.

In such a case, the temperature of each PTC element 73 reaches the Curie temperature T0 at time t2, and the PTC element 73 is further heated.

Then, at time t3, the temperature of the PTC element 73 reaches the temperature T1, where the PTC element 73 starts self-heating and is further heated.

Eventually, at time t4, the temperature of the PTC element 73 reaches the temperature T2, i.e., the stabilization point, and is maintained at the temperature T2.

Amount of Heat Generated

The amounts of heat generated by the resistance heating body 72, the PTC element 73, and the resistor 74 in each of the out-of-path areas that are on the outer sides of the area over which the small-size sheet P1 passes will now be described.

Figure 8A:
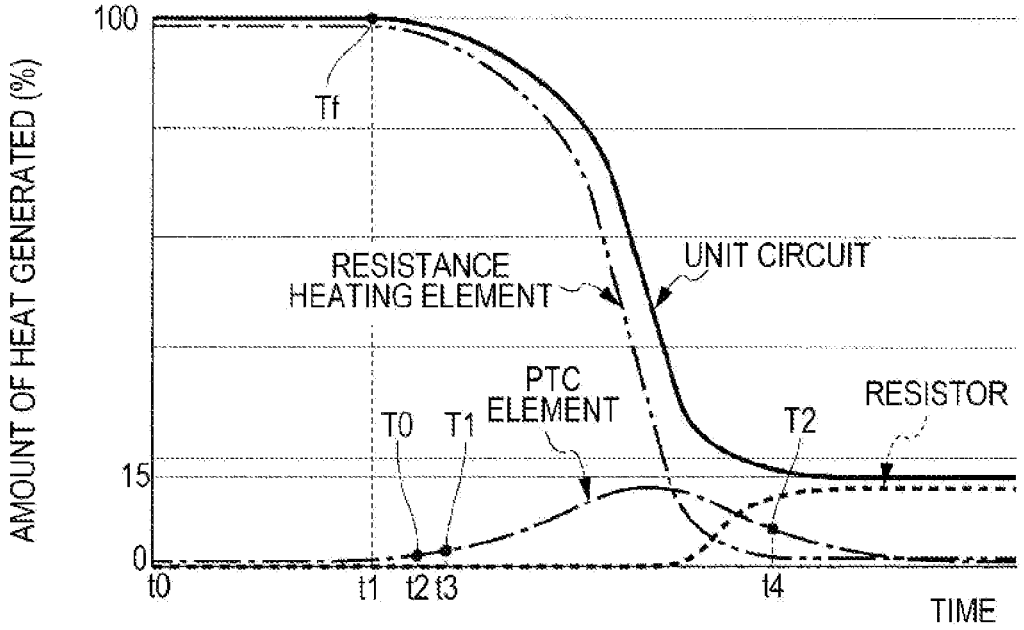
FIG. 8A is a graph illustrating changes in the amounts of heat (%) generated by a resistance heating body, the PTC element, a resistor, and a unit circuit, respectively, in an out-of-path area with respect to time.
Figure 8B:
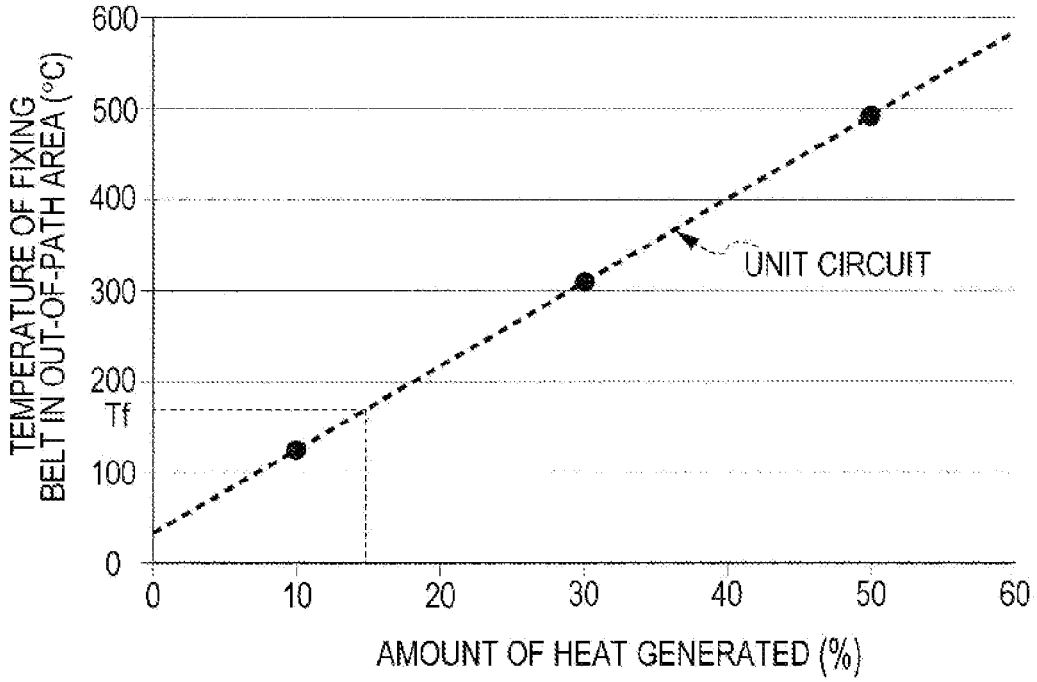
FIG. 8B is a graph illustrating the relationship between the temperature (° C.) of a fixing belt and the amount of heat (%) generated by the unit circuit in the out-of-path area.

FIG. 8A is a graph illustrating changes in the amounts of heat (%) generated by the resistance heating body 72, the PTC element 73, the resistor 74, and the unit circuit U, respectively, in the out-of-path area with respect to time. FIG. 8B is a graph illustrating the relationship between the temperature (° C.) of the fixing belt 78 and the amount of heat (%) generated by the unit circuit U in the out-of-path area. In FIG. 8A, the vertical axis represents the amount of heat generated (%), and the horizontal axis represents time. The amount of heat generated by the unit circuit U is the sum of the respective amounts of heat generated by the resistance heating body 72, the PTC element 73, and the resistor 74. In FIG. 8B, the vertical axis represents the temperature (° C.) of the fixing belt 78 in the out-of-path area, and the horizontal axis represents the amount of heat generated (%) by the unit circuit U.

The amount of heat (%) generated by the unit circuit U is calculated by defining the amount of heat generated in the case where the PTC element 73 is below the Curie temperature T0 as 100%.

Referring to FIG. 8A, changes in the amounts of heat generated by the resistance heating body 72, the PTC element 73, the resistor 74, and the unit circuit U in the out-of-path area with respect to time will now be described.

Suppose that a current starts to be supplied to the solid heater 71 at time t0. At time t0, the PTC element 73 is below the Curie temperature T0. Therefore, the current takes the route α (see FIG. 5) passing through the resistance heating body 72 and the PTC element 73 as described above.

Hence, the total amount of heat generated is the sum of the respective amounts of heat generated by the resistance heating body 72 and the PTC element 73. Note that most of the total amount of heat is generated by the resistance heating body 72.

At time t1, the temperature of the fixing belt 78 reaches the fixing temperature Tf, and a small-size sheet P1 starts to be transported through the fixing unit 60. The sheet P1 does not come into contact with the fixing belt 78 in the out-of-path areas. Therefore, the heat of the fixing belt 78 is not radiated, and the temperature of the PTC element 73 continues to rise.

At time t2, the temperature of the PTC element 73 reaches the Curie temperature T0. Accordingly, the resistance value R2 of the PTC element 73 starts to increase.

At time t3, the temperature of the PTC element 73 reaches the temperature T1. Then, the voltage applied to the PTC element 73 increases, and the amount of heat generated increases. When the amount of heat generated by the PTC element 73 becomes larger than the amount of heat radiated to the base member 75*a* of the solid heater 71 and to the fixing belt 78, the temperature of the PTC element 73 rapidly rises, that is, the PTC element 73 starts self-heating. When the resistance value R2 of the PTC element 73 rapidly increases with the self-heating of the PTC element 73, the current starts to be reduced. Accordingly, the amount of heat generated by the PTC element 73 starts to be reduced. If the resistance value R2 of the PTC element 73 exceeds the resistance value R3 of the resistor 74, the current taking the route α also takes the route β passing through the resistance heating body 72 and the resistor 74 (see FIG. 5).

Then, at time t4, the amount of heat generated by the PTC element 73 and the amount of heat radiated from the PTC element 73 becomes the same again, and the temperature of the PTC element 73 is stabilized at the temperature T2.

After time t4, the resistance value R2 of the PTC element 73 is large, and the current is small. Therefore, the amount of heat generated by the PTC element 73 does not contribute to the amount of heat generated by the unit circuit U. That is, the amount of heat generated by the unit circuit U is the sum of the amount of heat generated by the resistance heating body 72 and the amount of heat generated by the resistor 74. If the resistance value R3 of the resistor 74 is larger than the resistance value R1 of the resistance heating body 72, most of the heat is generated by the resistor 74, as described above.

Supposing that, for example, the resistance value R1 of the resistance heating body 72 is 100Ω and the resistance value R3 of the resistor 74 is 600Ω, the amount of heat generated in the case where the current takes the route β (see FIG. 5) is 15% of the amount of heat generated in the case where the current takes the route α (see FIG. 5).

The above state is maintained unless the supply of power from the power source 76 is stopped and the temperature of the PTC element 73 is reduced to a value below the Curie temperature T0.

Referring now to FIG. 8B, the relationship between the temperature of the fixing belt 78 and the amount of heat (%) generated by the unit circuit U in the out-of-path area will be described.

The amount of heat generated by the unit circuit U is set with consideration for the temperature of the fixing belt 78 in the out-of-path area. In the exemplary case described above, if the amount of heat generated by the unit circuit U is set to 15%, the temperature of the fixing belt 78 in the out-of-path area is maintained at the fixing temperature Tf of 170° C.

The amount of heat generated (%) is set on the basis of the resistance value R1 of the resistance heating body 72 and the resistance value R3 of the resistor 74.

Here, a comparative case where the unit circuits U of the solid heater 71 each do not include the resistor 74 will be described.

Figure 9:
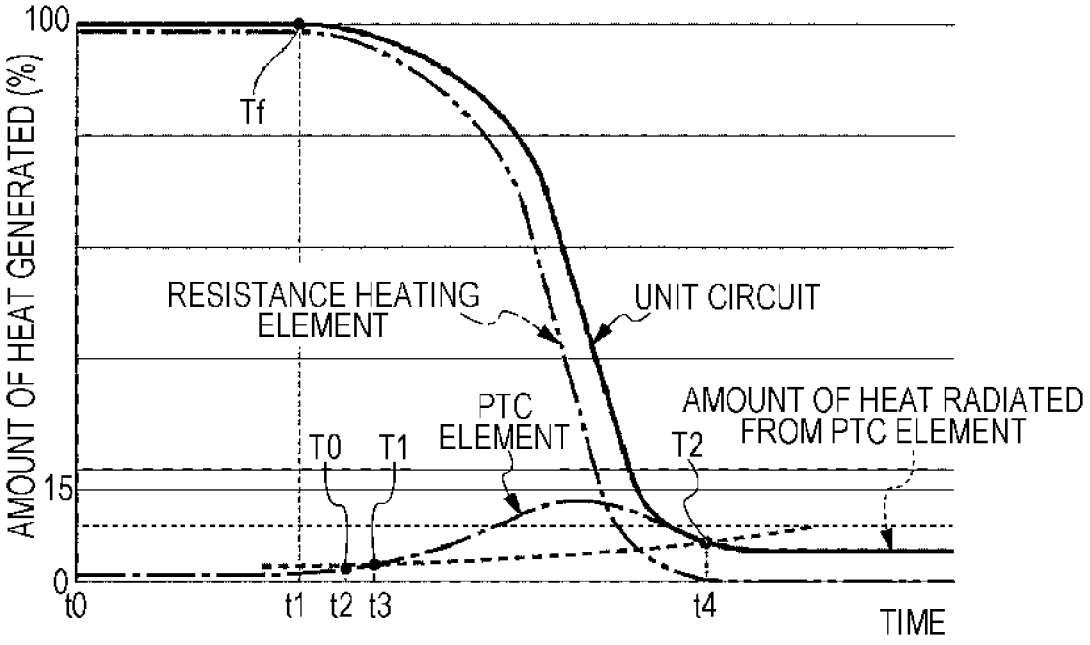
FIG. 9 is a graph illustrating changes in the amounts of heat (%) generated by the resistance heating body, the PTC element, and the unit circuit, respectively, in the out-of-path area with respect to time in a case where the unit circuit does not include the resistor.

FIG. 9 is a graph illustrating changes in the amounts of heat (%) generated by the resistance heating body 72, the PTC element 73, and the unit circuit U, respectively, in the out-of-path area with respect to time in a case where the unit circuit U does not include the resistor 74. In the graph illustrated in FIG. 9, the vertical axis represents the amount of heat generated (%), and the horizontal axis represents time. The amount of heat generated by the unit circuit U is the sum of the amount of heat generated by the resistance heating body 72 and the amount of heat generated by the PTC element 73.

In the case where the unit circuit U does not include the resistor 74, the current take the route α passing through the resistance heating body 72 and the PTC element 73, as is seen from FIG. 3.

The changes in the amount of heat generated (%) that are observed from time t0 to time t4 are the same as those illustrated in FIG. 8A, and description thereof is omitted.

The amount of heat generated by the unit circuit U at time 0 is 100%. At time 0, most of the heat is generated by the resistance heating body 72.

As graphed in FIG. 9, in the case where the unit circuit U does not include the resistor 74, most of the heat in the out-of-path area of the solid heater 71 after time t4 is generated by the PTC element 73. However, since the resistance value R2 of the PTC element 73 is large and the current flowing therethrough is small, it is difficult to heat the fixing belt 78 with the heat generated by the PTC element 73.

That is, providing the resistor 74 in the unit circuit U allows the current to take the route β (see FIG. 5) passing through the resistance heating body 72 and the resistor 74 if the temperature of the PTC element 73 has reached the temperature T2 and the resistance value R2 of the PTC element 73 has increased. Thus, the temperature of the fixing belt 78 in the out-of-path area is prevented from dropping.

Temperature Distribution of Fixing Belt 78

Figure 10A:
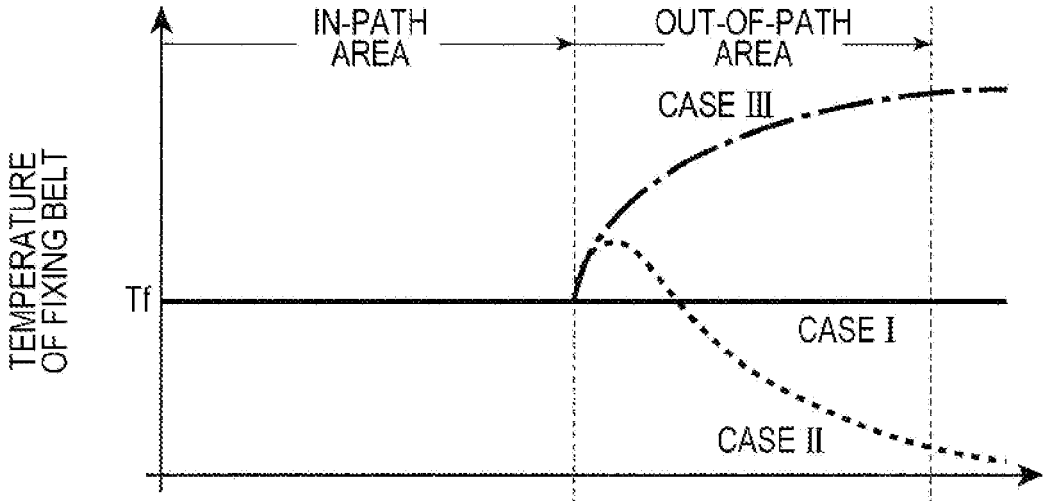
FIG. 10A is a graph illustrating the temperature distribution of the fixing belt in a width direction in a case where plural small-size sheets are sequentially subjected to a fixing process.
Figure 10B:
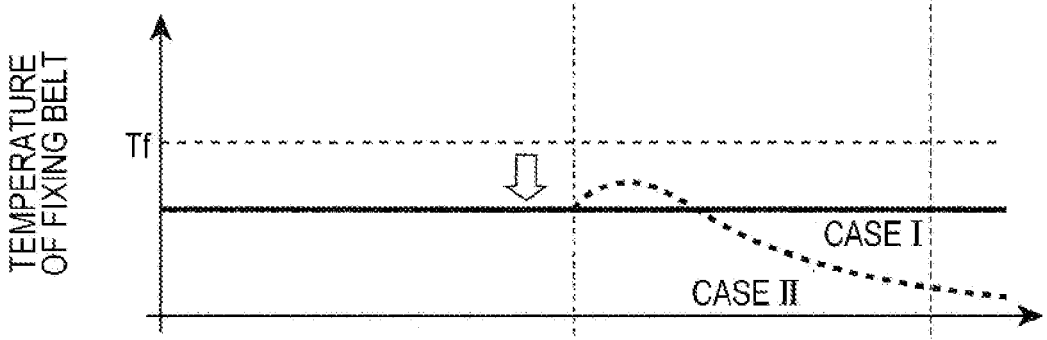
FIG. 10B is a graph illustrating the temperature distribution of the fixing belt in the width direction in a case where the supply of a current from a power source has been stopped.
Figure 10C:
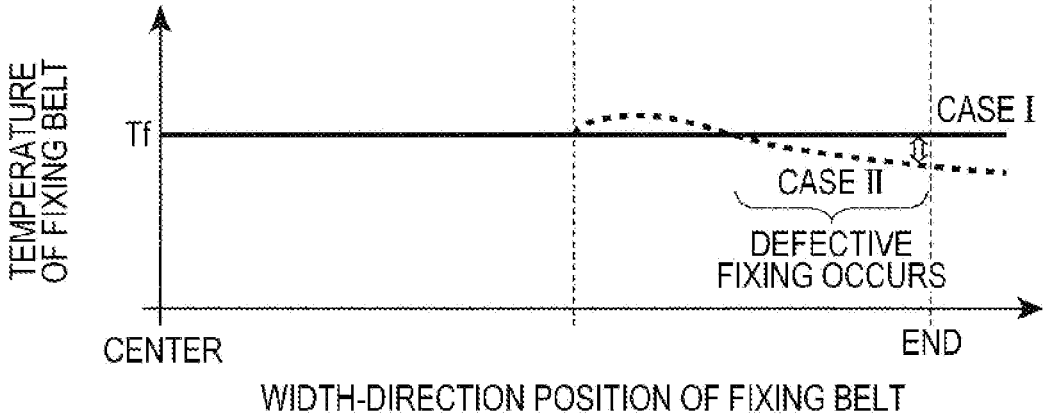
FIG. 10C is a graph illustrating the temperature distribution of the fixing belt in the width direction in a case where the supply of the current from the power source is restarted for the reheating of the fixing belt.

FIGS. 10A to 10C are graphs illustrating the temperature distribution of the fixing belt 78 in the width direction W. FIG. 10A illustrates a case where plural small-size sheets P1 are sequentially subjected to the fixing process. FIG. 10B illustrates a case where the supply of the current from the power source 76 has been stopped. FIG. 10C illustrates a case where the supply of the current from the power source 76 is restarted for the reheating of the fixing belt 78. The horizontal axis of each of the graphs illustrated in FIGS. 10A to 10C represents the position of the fixing belt 78 in the width direction W, from the center to an end of the fixing belt 78 (having the width W0) illustrated in FIG. 3. As illustrated in FIG. 3, a central portion corresponds to the in-path area for the small-size sheet P1, and an end portion corresponds to the out-of-path area for the small-size sheet P1.

In Case I, the unit circuit U includes the resistance heating body 72, the PTC element 73, and the resistor 74. In Case II, the unit circuit U includes the resistance heating body 72 and the PTC element 73 but does not include the resistor 74. In Case III, the unit circuit U includes the resistance heating body 72 but does not include the PTC element 73 and the resistor 74.

Referring to FIG. 10A, when plural small-size sheets P1 are sequentially subjected to the fixing process, a portion of the fixing belt 78 in the in-path area for the small-size sheet P1 radiates heat by coming into contact with each of the sheets P1 and is maintained at the fixing temperature Tf in each of Cases I, II, and III.

However, a portion of the fixing belt 78 in the out-of-path area for the sheet P1 does not come into contact with the sheet P1 and does not therefore radiate heat to the sheet P1.

In Case III where the unit circuit U includes the resistance heating body 72 but does not include the PTC element 73 and the resistor 74, the current continues to be supplied to the resistance heating body 72. Therefore, the temperature of the fixing belt 78 in the out-of-path area continues to rise. In the out-of-path area, as represented by the dash-dot line in FIG. 10A, the temperature of the fixing belt 78 becomes higher from the boundary between the in-path area and the out-of-path area toward the end. Hence, the end portion of the fixing belt 78 may be overheated.

Now, Case II where the unit circuit U includes the resistance heating body 72 and the PTC element 73 but does not include the resistor 74 will be discussed. In the stabilized state observed after time t4 where the temperature of the PTC element 73 is above the Curie temperature T0 and the resistance value R2 has increased correspondingly, the amount of heat generated by the unit circuit U is, as graphed in FIG. 9, below 15%, which is too low to maintain the temperature in the out-of-path area to be substantially the same as the temperature in the in-path area. That is, as graphed by the dotted line in FIG. 10A, the temperature of the fixing belt 78 in the out-of-path area becomes lower from the boundary between the in-path area and the out-of-path area toward the end.

In Case II, the temperature of the fixing belt 78 rises in a portion of the out-of-path area that is near the boundary between the in-path area and the out-of-path area. Such a phenomenon occurs in a case where the boundary between the in-path area and the out-of-path area extends over the unit circuit U including the resistance heating body 72 and the PTC element 73. For example, if a part of the PTC element 73 overlaps the in-path area, the temperature of the PTC element 73 does not exceeds the Curie temperature T0. Hence, the current flows through the resistance heating body 72, and the temperature of the fixing belt 78 in a portion of the out-of-path area that is near the boundary between the in-path area and the out-of-path area rises.

Such a phenomenon may occur also in Cases I and III but is not graphed.

In Case I where the unit circuit U includes the resistance heating body 72, the PTC element 73, and the resistor 74, when the temperature of the PTC element 73 exceeds the Curie temperature T0 and the resistance value R2 increases in the out-of-path area, the current takes the route β (see FIG. 5) passing through the resistance heating body 72 and the resistor 74. Therefore, the temperature of the fixing belt 78 in the out-of-path area is maintained at a predetermined temperature (hereinafter, the predetermined temperature is regarded as the fixing temperature Tf). That is, in Case I, the difference between the temperature in the in-path area and the temperature in the out-of-path area is suppressed to a smaller value than in Case II.

Referring now to FIG. 10B, to cancel the situation where the resistance value R2 of the PTC element 73 has increased, the supply of the current from the power source 76 is stopped. Hereinafter, description of Case III is omitted.

Accordingly, the temperature distribution of the fixing belt 78 has a similar tendency, both in the in-path area and in the out-of-path area, to the temperature distribution observed before the supply of the current from the power source 76 is stopped (the temperature distribution illustrated in FIG. 10A).

That is, Case II exhibits a tendency that the temperature of the fixing belt 78 in the out-of-path area becomes lower from the boundary between the in-path area and the out-of-path area toward the end.

In contrast, in Case I where the temperature difference between the in-path area and the out-of-path area is suppressed to a small value, the temperature of the fixing belt 78 is low and is evenly distributed both in the in-path area and in the out-of-path area.

Note that the PTC element 73 has a small heat capacity. Therefore, when the supply of the current from the power source 76 is stopped, the temperature of the PTC element 73 drops to a temperature below the Curie temperature T0 rapidly, for example, in one second or shorter.

In the case graphed in FIG. 10C where the supply of the current from the power source 76 is restarted, the fixing belt 78 is reheated by the solid heater 71. In this case, the temperature distribution of the fixing belt 78 has a similar tendency to the temperature distribution observed before the fixing belt 78 is reheated.

Case II exhibits a tendency that the temperature of the fixing belt 78 becomes lower from the boundary between the in-path area and the out-of-path area toward the end. Particularly, the temperature of the fixing belt 78 is low in a portion near the end. Therefore, the temperature of the fixing belt 78 in the portion near the end (the end portion) does not easily reach the fixing temperature Tf.

Hence, if a large-size sheet P2 is fed into the fixing unit 60 in a state where the temperature of the fixing belt 78 in the in-path area has reached the fixing temperature Tf but the end portions of the fixing belt 78 are still below the fixing temperature Tf, defective fixing may occur in the end portions of the fixing belt 78 that are below the fixing temperature Tf.

To avoid such a situation, the fixing process may be withheld until the temperature in each of the end portions of the fixing belt 78 reaches the fixing temperature Tf. In such a case, however, the waiting time (standby time) increases.

In contrast, in Case I where the temperature difference between the in-path area and the out-of-path area is small before the fixing belt 78 is reheated, the temperature difference between the in-path area and the out-of-path area that is observed after the fixing belt 78 is reheated is also small. Hence, the difference in time taken before the temperature of the fixing belt 78 reaches the fixing temperature Tf is small between that in the in-path area and that in the out-of-path area. That is, the waiting time (standby time) taken before the temperature of the fixing belt 78 reaches the fixing temperature Tf is shorter and the probability that defective fixing may occur is lower than in the case where the unit circuit U does not include the resistor 74.

Even if Case I exhibits the tendency observed in Case II graphed in FIG. 10A that the temperature rises in a portion of the out-of-path area that is near the boundary between the in-path area and the out-of-path area, defective fixing does not occur because the temperature of the fixing belt 78 in the above portion is higher than the fixing temperature Tf.

The width of the portion where the temperature becomes high may be reduced by reducing the pitch of the unit circuits U that are aligned in the solid heater 71 in the width direction W of the fixing belt 78.

Second Exemplary Embodiment

In the first exemplary embodiment, the resistor 74 included in each of the unit circuits U of the solid heater 71 is, for example, a chip resistor such as a metal-glaze resistor.

In a second exemplary embodiment of the present invention, the resistor 74 is made of the same resistive material as the resistance heating body 72. The second exemplary embodiment differs from the first exemplary embodiment in the configuration of the solid heater 71, and the other elements employed in the second exemplary embodiments are the same as those employed in the first exemplary embodiment. The following description focuses on the difference from the first exemplary embodiment, and description of the elements that are the same as those of the first exemplary embodiment is omitted.

Solid Heater 71

Figure 11:
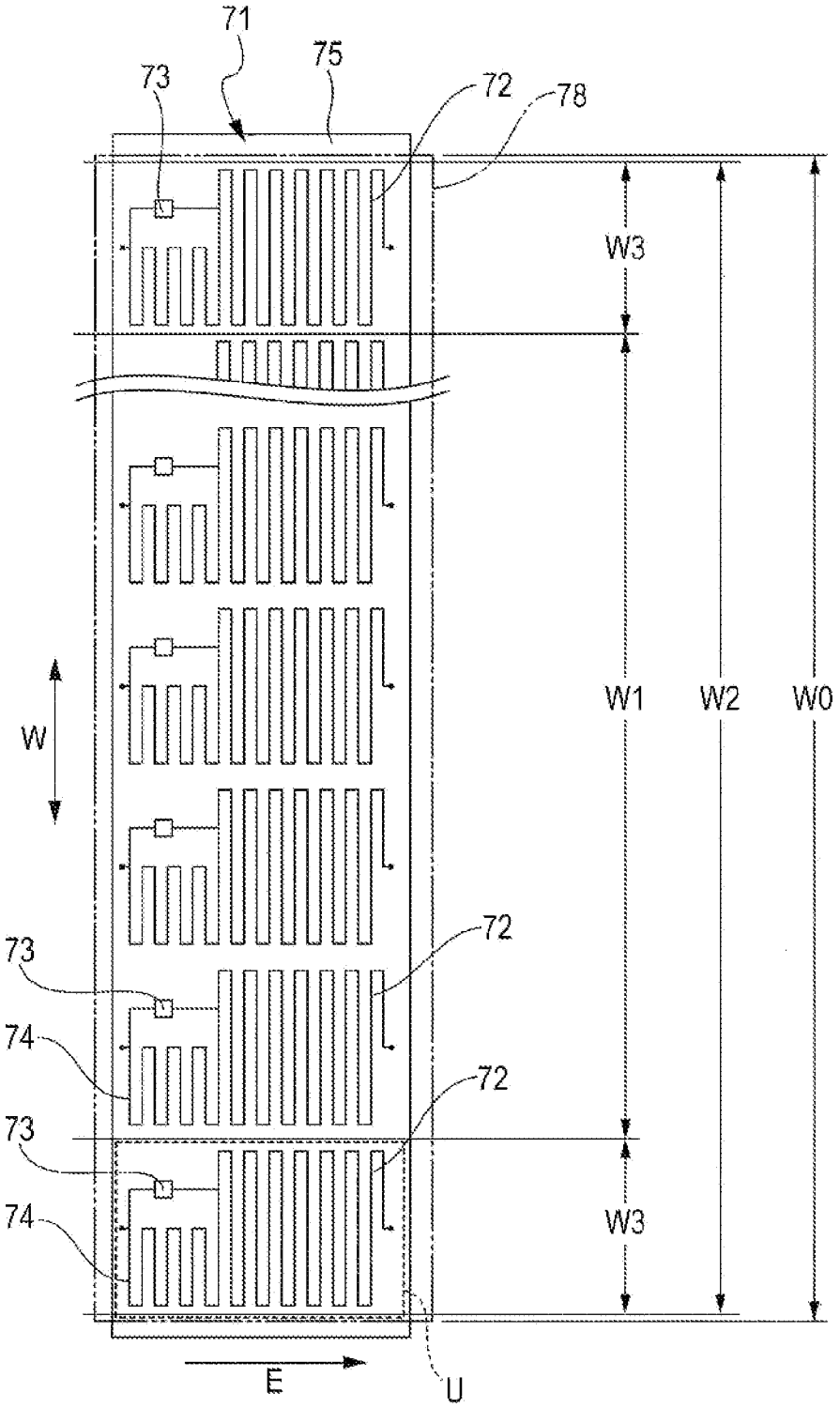
FIG. 11 illustrates a solid heater according to a second exemplary embodiment of the present invention that is seen in a direction of arrow XI illustrated in FIG. 2.

FIG. 11 illustrates a solid heater 71 according to the second exemplary embodiment that is seen in a direction of arrow XI illustrated in FIG. 2.

The solid heater 71 includes plural unit circuits U and a supporting member 75 that supports the plural unit circuits U. The unit circuits U each include a resistance heating body 72, a PTC element 73, and a resistor 74.

The resistor 74 according to the second exemplary embodiment is provided as an extension of the resistance heating body 72. That is, the resistor 74 is made of, for example, AgPd. The resistor 74 may be made of a material different from the material of the resistance heating body 72.

In each of the unit circuits U, the PTC element 73 is connected in series to the resistance heating body 72, and the resistor 74 is connected in parallel to the PTC element 73. That is, the resistor 74 serves as a parallel circuit with respect to the PTC element 73.

In the solid heater 71 according to the second exemplary embodiment, the resistors 74 may be formed simultaneously with the resistance heating bodies 72, and no chip resistors such as metal-glaze resistors are necessary.

That is, the solid heater 71 according to the second exemplary embodiment is more easily manufacturable than the solid heater 71 according to the first exemplary embodiment.

The operation of the solid heater 71 according to the second exemplary embodiment is the same as that described in the first exemplary embodiment, and description thereof is omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a rotating member configured to rotate; and a plurality of unit circuits that are aligned in a width direction of the rotating member, the plurality of unit circuits each including:

a heating body configured to heat the rotating member, a resistive element having a variable resistance, the resistive element being connected in series to the heating body and having a positive temperature coefficient, and a parallel circuit that is connected in parallel to the resistive element, wherein the unit circuits are each configured such that:

at a first time, a percentage of heat generated by the heating body is greater than a percentage of heat generated by the resistive element and greater than a percentage of heat generated by the parallel circuit, at a second time, the percentage of heat generated by the heating body is less than the percentage of heat generated by the resistive element, and at a third time, the percentage of heat generated by the parallel circuit is greater than the percentage of heat generated by the heating body and greater than the percentage of heat generated by the resistive element.

2. The heating device according to claim 1, wherein, at a first temperature that is less than a second temperature, a resistance value of the parallel circuit included in each of the unit circuits is larger than the resistance value of the resistive element, and at the second temperature the resistance value of the parallel circuit is smaller than the resistance value of the resistive element.

3. The heating device according to claim 1, wherein the rotating member is heated to a predetermined temperature when a current flows through the parallel circuit in each of the unit circuits with a rise of a temperature of the resistive element.

4. A fixing device comprising:

a heating device that includes a rotating member configured to rotate, and a plurality of unit circuits that are aligned in a width direction of the rotating member, the plurality of unit circuits each including:

a heating body configured to heat the rotating member, a resistive element having a variable resistance, the resistive element being connected in series to the heating body and having a positive temperature coefficient, and a parallel circuit that is connected in parallel to the resistive element; and a pressing member that is in contact with the rotating member heated by the heating body, the pressing member and the rotating member providing a nip part where each of a plurality of kinds of recording media having different sizes in the width direction is nipped, wherein the unit circuits of the heating device are each configured such that:

at a first time, a percentage of heat generated by the heating body is greater than a percentage of heat generated by the resistive element and greater than a percentage of heat generated by the parallel circuit, at a second time, the percentage of heat generated by the heating body is less than the percentage of heat generated by the resistive element, and at a third time, the percentage of heat generated by the parallel circuit is greater than the percentage of heat generated by the heating body and greater than the percentage of heat generated by the resistive element, and wherein at least one of the unit circuits is provided at a position in an out-of-path area that is on an outer side of an area over which a smallest one of the recording media to be nipped in the nip part passes.

5. An image forming apparatus comprising:

a fixing device configured to fix a toner image to a recording medium, the fixing device including:

a heating device including a rotating member configured to rotate, and a plurality of unit circuits that are aligned in a width direction of the rotating member, the plurality of unit circuits each including:

a heating body configured to heat the rotating member, a resistive element having a variable resistance, the resistive element being connected in series to the heating body and having a positive temperature coefficient, and a parallel circuit that is connected in parallel to the resistive element, and a pressing member that is in contact with the rotating member heated by the heating body, the pressing member and the rotating member providing a nip part where the recording medium is nipped, the recording medium being one of a plurality of kinds of recording media having different sizes in the width direction; and a transporting portion configured to transport each of the plurality of kinds of recording media having different sizes in the width direction toward the fixing device, wherein the unit circuits of the heating device included in the fixing device are each configured such that:

at a first time, a percentage of heat generated by the heating body is greater than a percentage of heat generated by the resistive element and greater than a percentage of heat generated by the parallel circuit, at a second time, the percentage of heat generated by the heating body is less than the percentage of heat generated by the resistive element, and at a third time, the percentage of heat generated by the parallel circuit is greater than the percentage of heat generated by the heating body and greater than the percentage of heat generated by the resistive element, and wherein at least one of the unit circuits is provided at a position in an out-of-path area that is on an outer side of an area over which a smallest one of the recording media to be transported by the transporting portion and to be nipped in the nip part passes.

* * * * *